US006905221B2

(12) United States Patent
Hsu

(10) Patent No.: US 6,905,221 B2
(45) Date of Patent: Jun. 14, 2005

(54) SCREWDRIVER WITH LIGHT DEVICE

(75) Inventor: Hung-Ming Hsu, Taichung (TW)

(73) Assignee: Mobiletron Electronic Co., Ltd., Taichung Hsien (TW)

( * ) Notice: Subject to any disclaimer, the term of this patent is extended or adjusted under 35 U.S.C. 154(b) by 151 days.

(21) Appl. No.: 10/606,888

(22) Filed: Jun. 27, 2003

(65) Prior Publication Data

US 2004/0264178 A1 Dec. 30, 2004

(51) Int. Cl.[7] ..... B25B 23/18

(52) U.S. Cl. ..... 362/119; 362/120; 362/394; 362/395; 362/205; 362/206

(58) Field of Search ..... 362/119, 120, 362/394, 395, 205, 206

(56) References Cited

U.S. PATENT DOCUMENTS 5,143,441 A * 9/1992 Maglica ..... 362/203
5,205,640 A * 4/1993 Shin ..... 362/205
5,213,408 A * 5/1993 Shiau ..... 362/187
6,022,121 A * 2/2000 Lin ..... 362/119
6,033,082 A * 3/2000 Lin ..... 362/120
6,095,659 A * 8/2000 Hsu ..... 362/119
6,179,433 B1 * 1/2001 Shiao ..... 362/120
6,193,388 B1 * 2/2001 Halasz et al. ..... 362/205
6,354,715 B1 * 3/2002 Halasz et al. ..... 362/187

* cited by examiner

*Primary Examiner*—Sandra O'Shea
*Assistant Examiner*—Jacob Y. Choi
(74) *Attorney, Agent, or Firm*—Bacon & Thomas PLLC

(57) ABSTRACT

A screwdriver includes a handle and a plastic gear mechanism which drives a bit engaging device by a power source connected to the handle. A positive plate and a negative plate are respectively connected to the handle. A light frame has at least one light bulb connected thereto and a positive ring and a negative ring are respectively engaged with the light frame. A spring is mounted to the bit engaging device and connected between the negative ring and the negative plate. The at least one light bulb is connected to the positive ring and the negative ring. A gap is defined between the positive plate and an extension of the positive ring. An annular switch is rotatably mounted to the light frame and includes a touch piece which contacts both of the position plate and the extension of the positive ring to light the at least one light bulb.

13 Claims, 17 Drawing Sheets

SCREWDRIVER WITH LIGHT DEVICE

FIELD OF THE INVENTION

The present invention relates to screwdriver having a light device connected to an end surface of the handle and an annular switch is rotatably connected to the handle.

BACKGROUND OF THE INVENTION

A conventional screwdriver with a light device is developed for a period of time and the light device provides illumination feature for the user in a dark work site. This feature is convenient for the users and welcomed in the market, nevertheless, the light device is simply attached to a screwdriver as an extra attachment so that the light bulb generally protrudes from the outer periphery of the handle and could impede the operation of the screwdriver in a narrow space. Besides, the appearance of the handle is not satisfied by three users because the light device and the switch both protrude from the handle. Furthermore, the conventional light device can only be attached to a periphery of the handle so that the light beam cannot be focused onto the same spot where the object is to be tightened or loosened by the screwdriver.

The present invention intends to provide a screwdriver that has a light device located at an end surface of the handle and the switch is in flush with the outer surface of the handle.

SUMMARY OF THE INVENTION

In accordance with one aspect of the present invention, there is provided a screwdriver that includes a handle with a plastic gear mechanism received therein and a bit engaging device is connected to a first end of the gear mechanism. A power source is connected to the gear mechanism. A positive plate and a negative plate are respectively connected to the gear mechanism. A light frame is received in the handle and at least one light bulb is connected to the light frame. A positive ring and a negative ring are respectively engaged with the light frame. A spring is mounted to the bit engaging device and connected between the negative ring and the negative plate. The at least one light bulb is connected to the positive ring and the negative ring. A gap is defined between the positive plate and an extension of the positive ring.

An annular switch is rotatably mounted to the gear mechanism and includes a touch piece which contacts both of the position plate and the extension of the positive ring to light the at least one light bulb.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
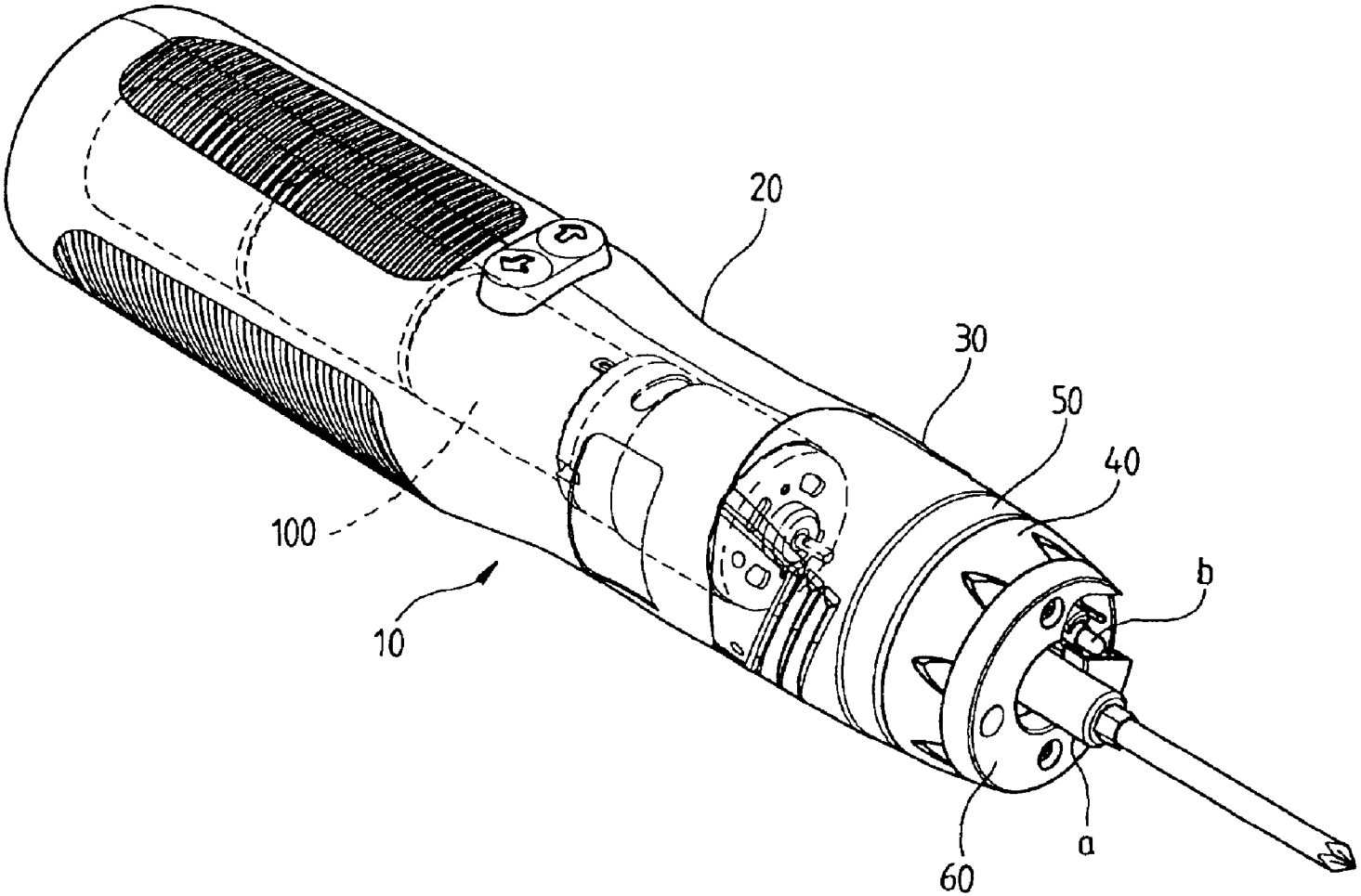
FIG. 1 is a perspective view to show a screwdriver of the present invention.
Figure 2:
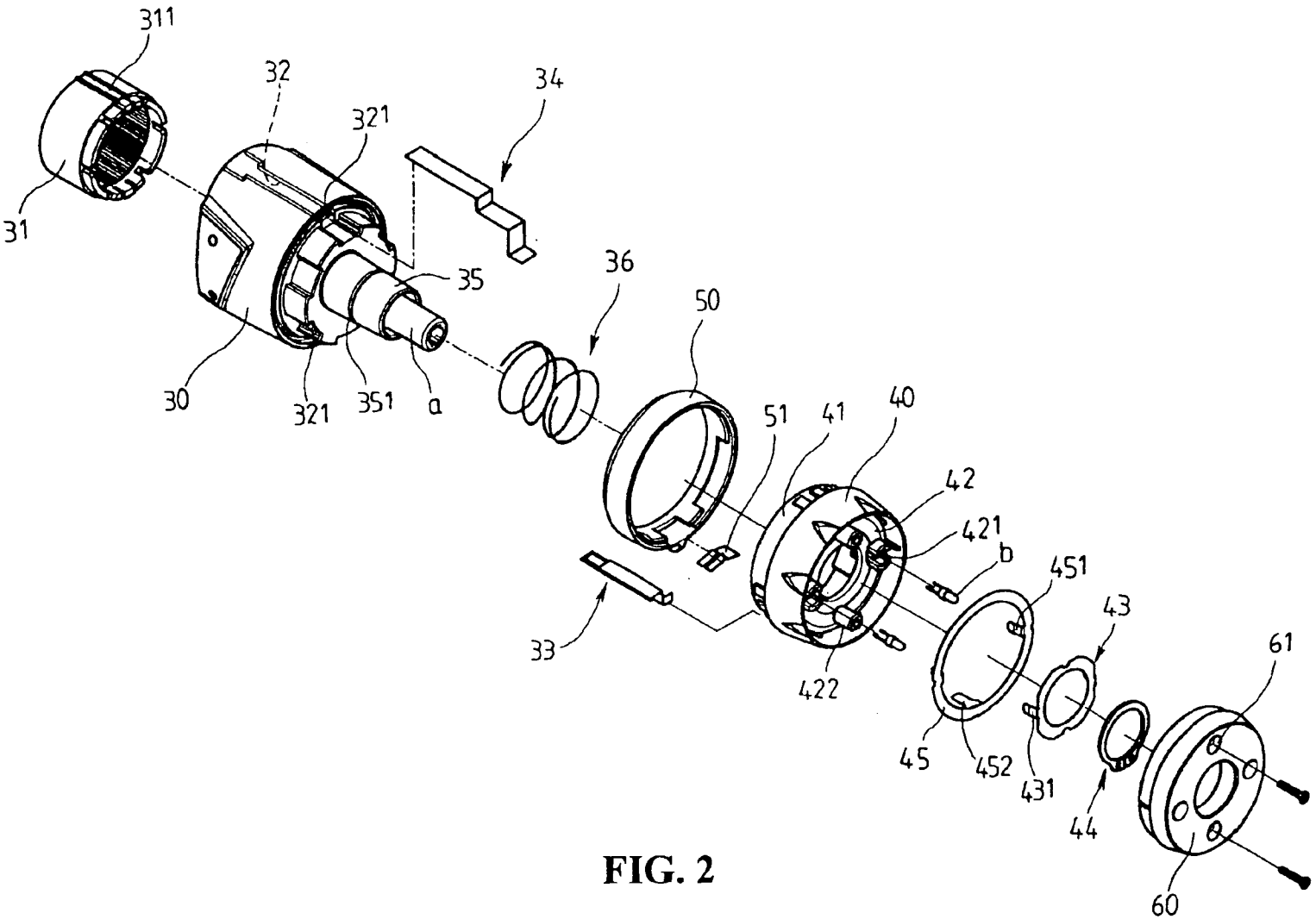
FIG. 2 is an exploded view to show the light device and the gear mechanism for the screwdriver of the present invention.
Figure 3A:
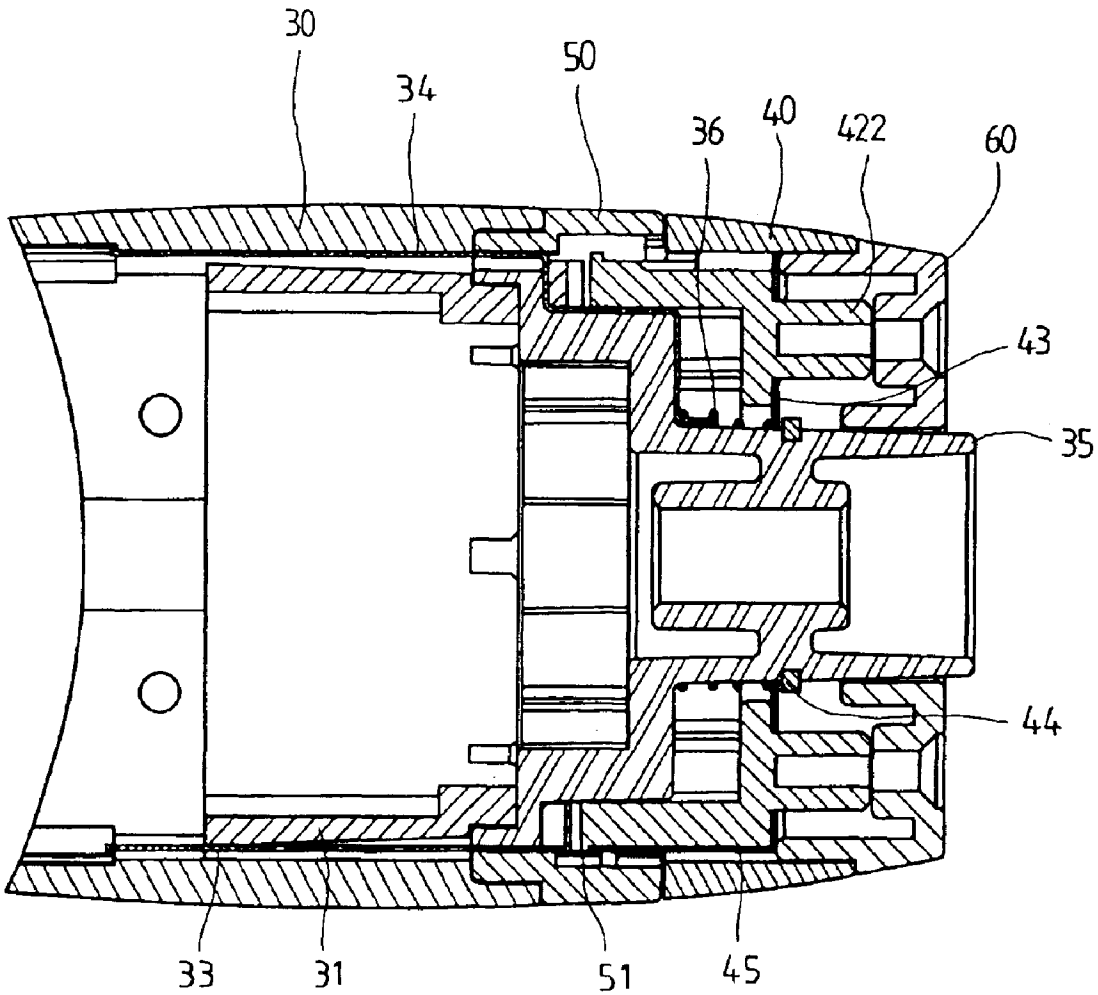
FIG. 3A is a cross sectional view to show the contact piece of the annular switch contacts the position plate and the extension of the positive ring.
Figure 3B:
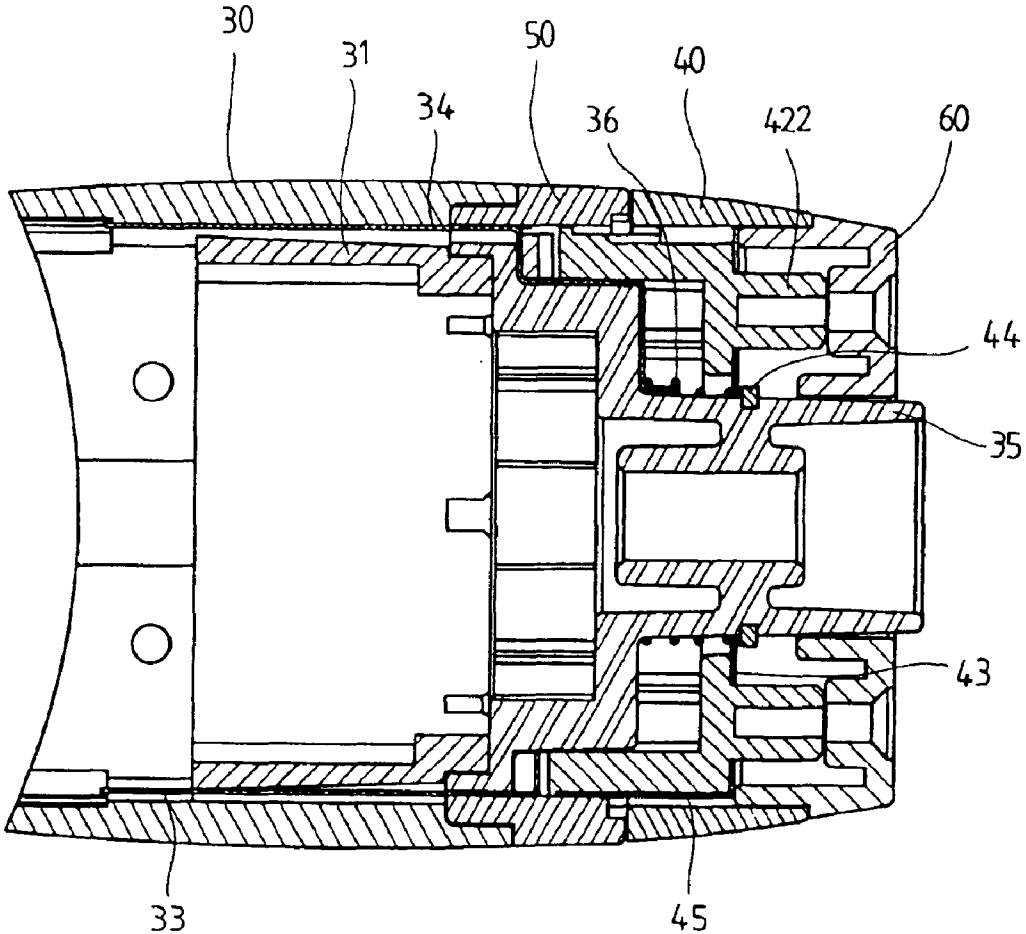
FIG. 3B is a cross sectional view to show the contact piece of the annular switch is removed not to contact the position plate and the extension of the positive ring.
Figure 3C:
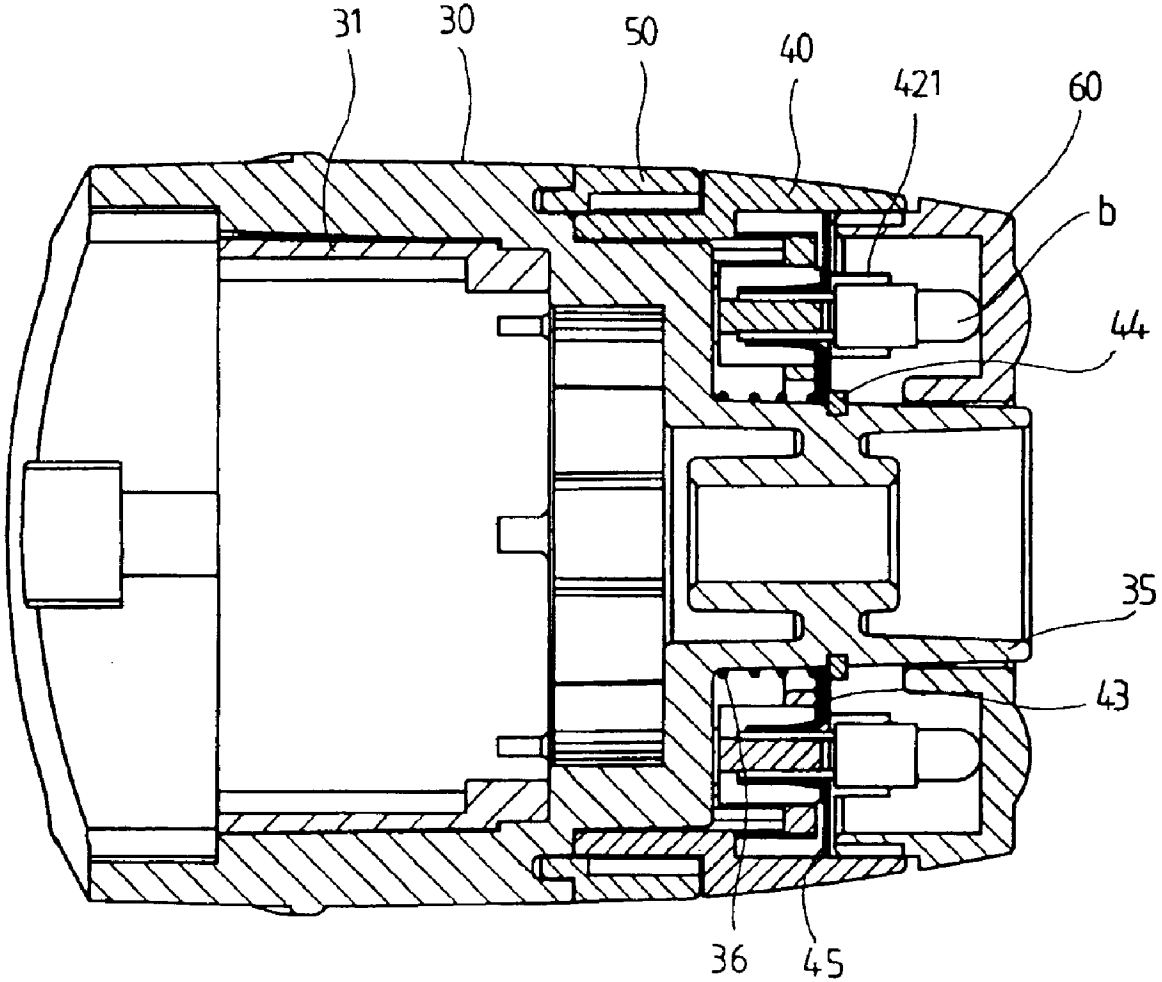
FIG. 3C shows the light bulbs connected to the light frame.
Figure 4:
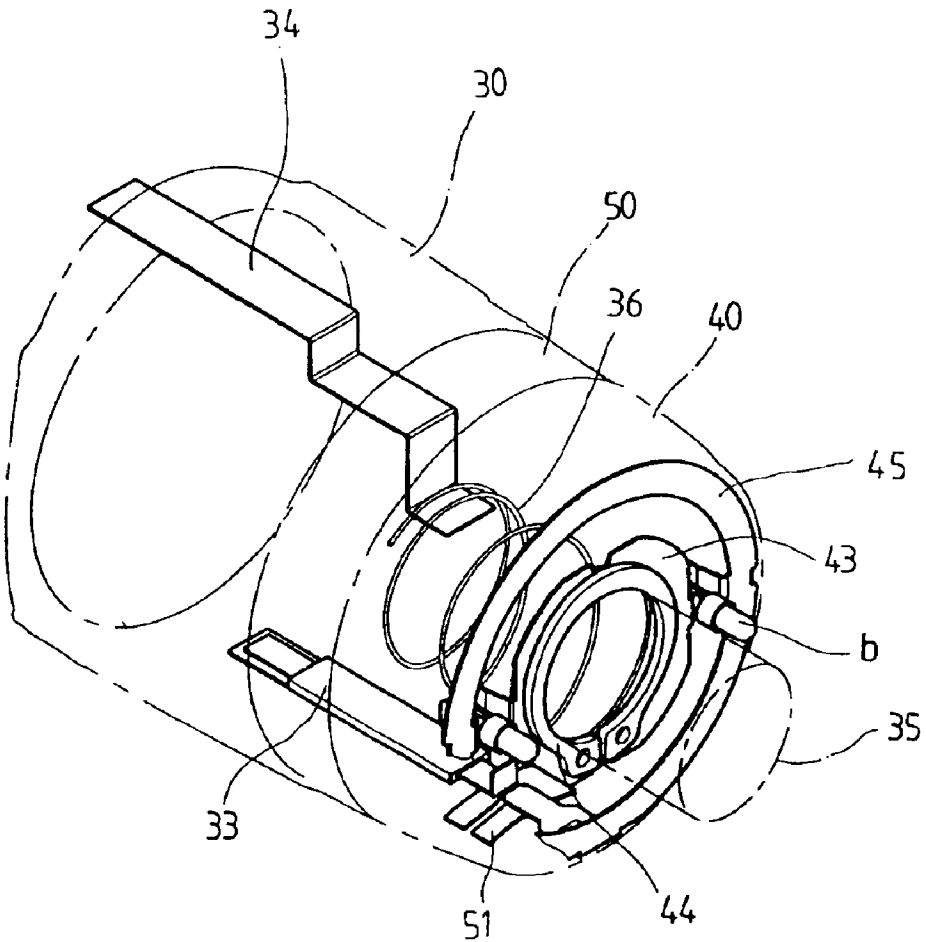
FIG. 4 shows the arrangement of the positive plate, the negative plate and the light frame.

Referring to FIGS. 1, 2, 3A, 3B, 3C and 4, the screwdriver 10 of the present invention comprises a handle 20 having a plastic gear mechanism 30 and a bit engaging device 35 is connected to a first end of the gear mechanism 30 so that a sleeve "a" can be connected to the bit engaging device 35. A power source 100 is connected to the gear mechanism 30 so as to provide electric power to the gear mechanism 30 to rotate the sleeve "a". The gear mechanism 30 includes a ring 31 which includes teeth defined in an inner periphery thereof so as to drive gears (not shown) in the gear mechanism 30. Two ridges 311 extending from an outer periphery of the ring 31 and are engaged with grooves 32 (only one is shown) defined longitudinally in the gear mechanism 30. A positive plate 33 and a negative plate 34 are respectively inserted into the grooves 32 via openings 321 in the first end of the gear mechanism 30.

A light frame 40 is connected to the gear mechanism 30 and includes two bulb receiving members 421 on a flange 42 of an inner periphery of the light frame 40. Two light bulbs "b" are connected to the bulb receiving members 421 of the light frame 40. The light frame 40 includes a connection end 41 which is connected to the gear mechanism 30. A positive ring 45 and a negative ring 43 are respectively engaged with the light frame 40. The positive ring 45 has two connection pieces 451 inserted in the two bulb receiving members 421 and the negative ring 43 has two connection pieces 431 which are inserted in the two bulb receiving members 421 so that the two light bulbs "b" are connected to the positive ring 45 and the negative ring 43. A fixing collar 44 is engaged in a groove 351 defined in an outer periphery of the bit engaging device 35 so as to press the negative ring 43 in position.

A fixing ring 60 which is engaged with the first end of the gear mechanism 30 and includes a central hole through which the bit engaging device 35 extends. Two positioning holes and two bulb holes 61 are defined through the fixing ring 60. The light frame 40 includes two positioning rods 422 which extend through the positioning holes and the light bulbs "b" extend through the two bulb holes 61.

A spring 36 is mounted to the bit engaging device 35 and connected between the negative ring 43 and the negative plate 34. A gap is defined between the positive plate 33 and an extension 452 of the positive ring 45 to form an open circuit for the light bulbs "b".

An annular switch 50 is rotatably mounted to the light frame 40 and includes a touch piece 51 which protrudes inward from an inner periphery of the annular switch 50 and can be moved to contact both of the position plate 33 and the extension 452 of the positive ring 45 by rotating the annular switch 50 to light the light bulbs "b".

The light bulbs "b" are located at the end of the gear mechanism 30 and the annular switch 50 is in flush with the outer periphery of the handle 20 so that the present invention improves the shortcomings of the conventional light device on the screwdriver.

Figure 5:
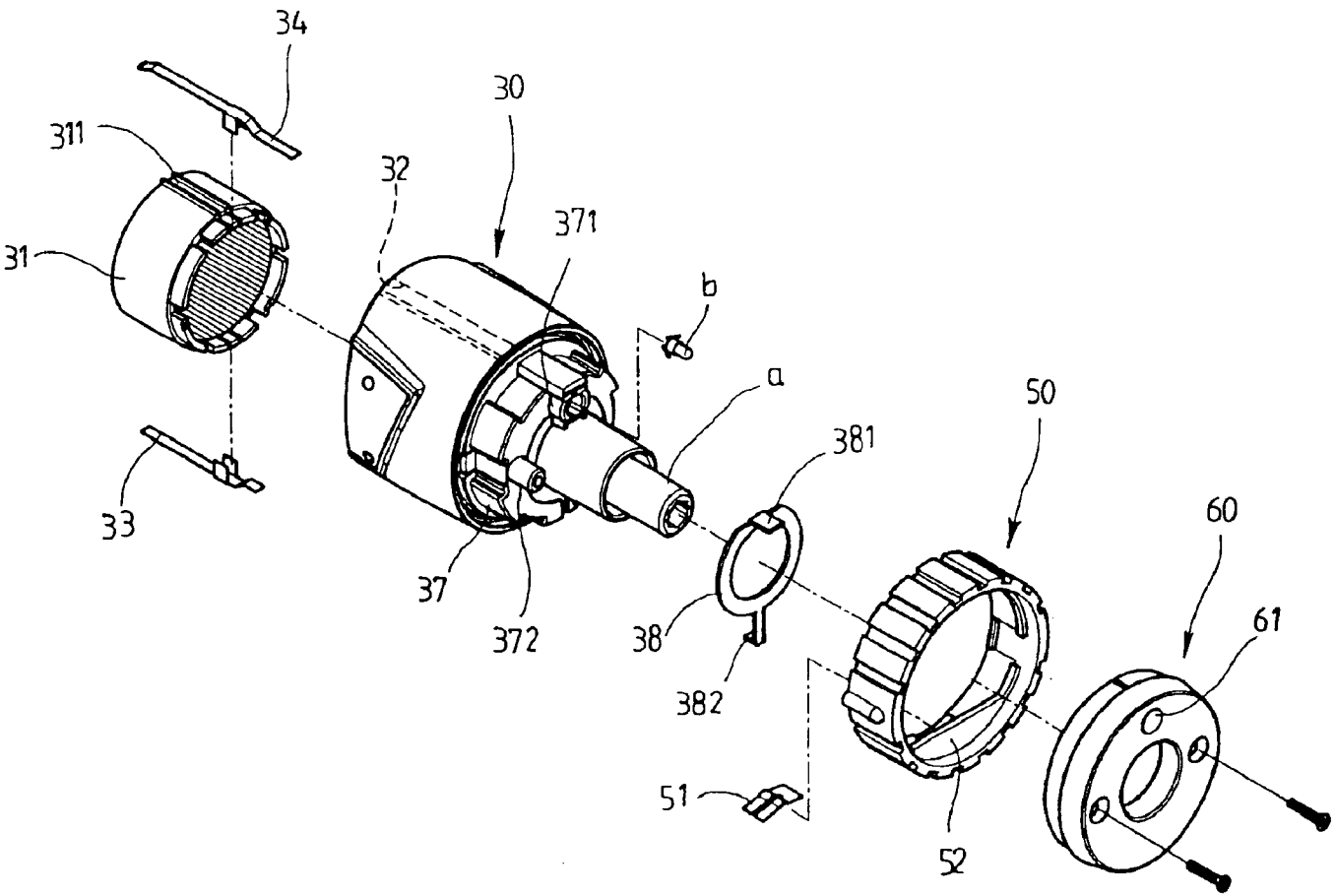
FIG. 5 shows another embodiment of the light device of the present invention.
Figure 6:
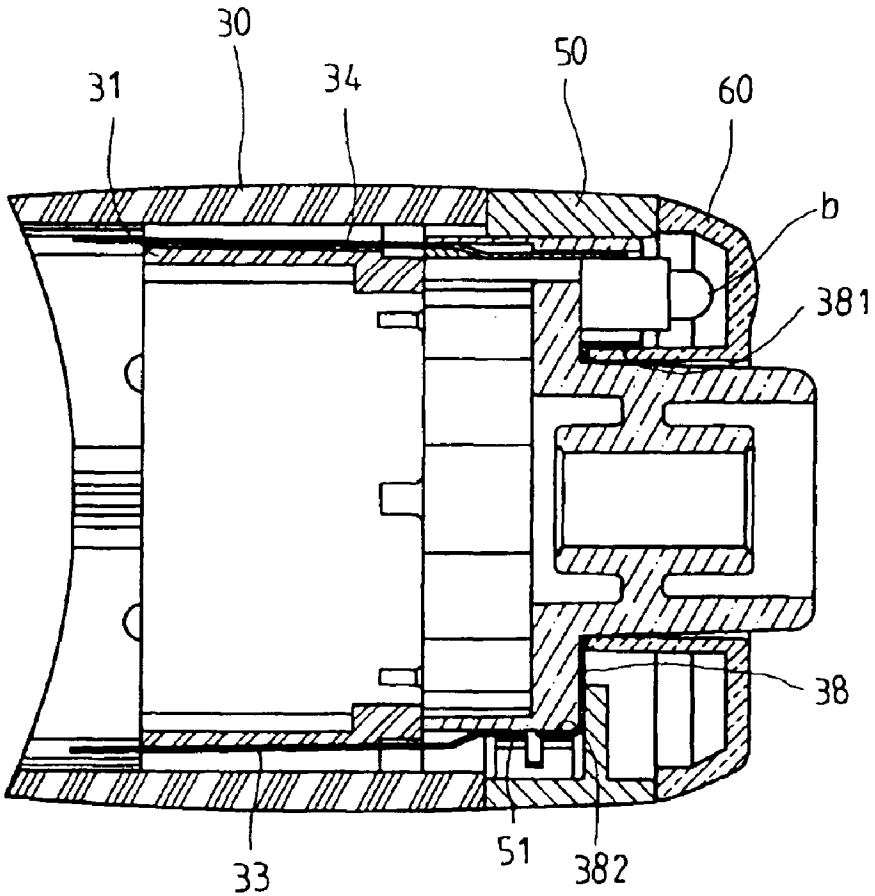
FIG. 6 is a side cross sectional view to show the embodiment shown in FIG. 5.
Figure 7:
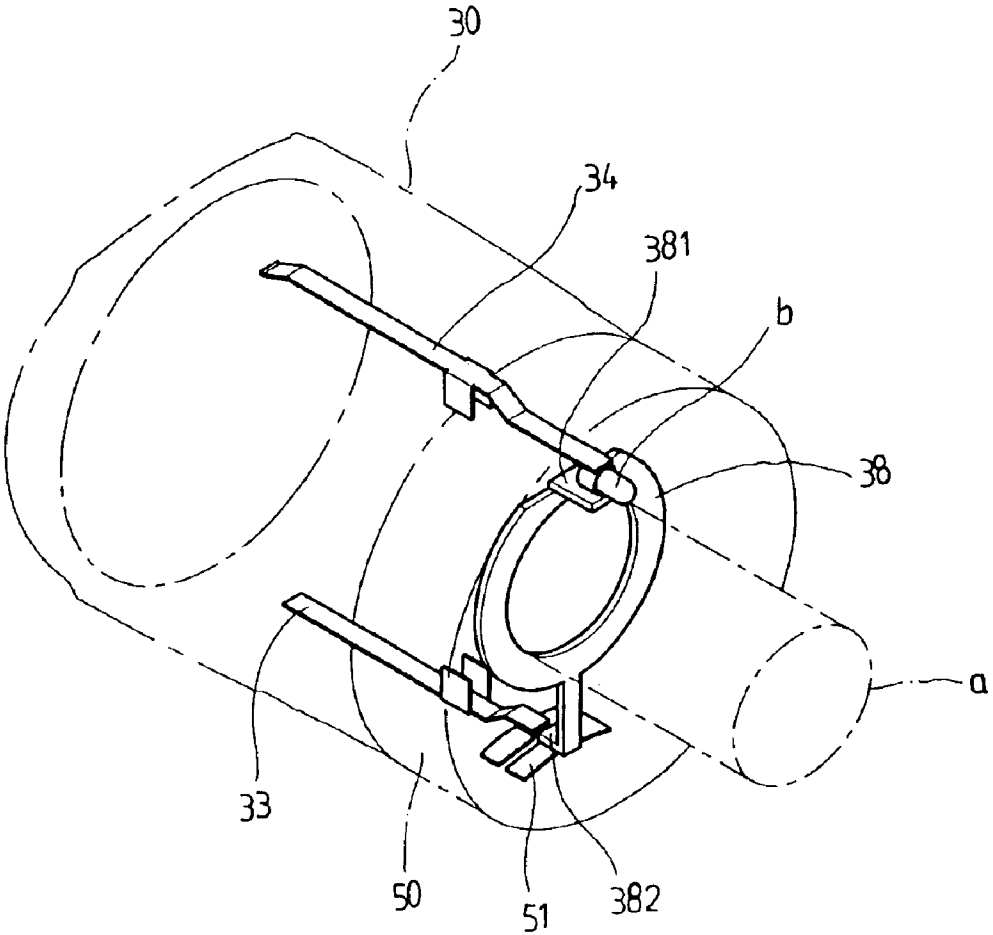
FIG. 7 shows the arrangement of the positive plate, the negative plate, the positive ring of the embodiment shown in FIG. 5.
Figure 8:
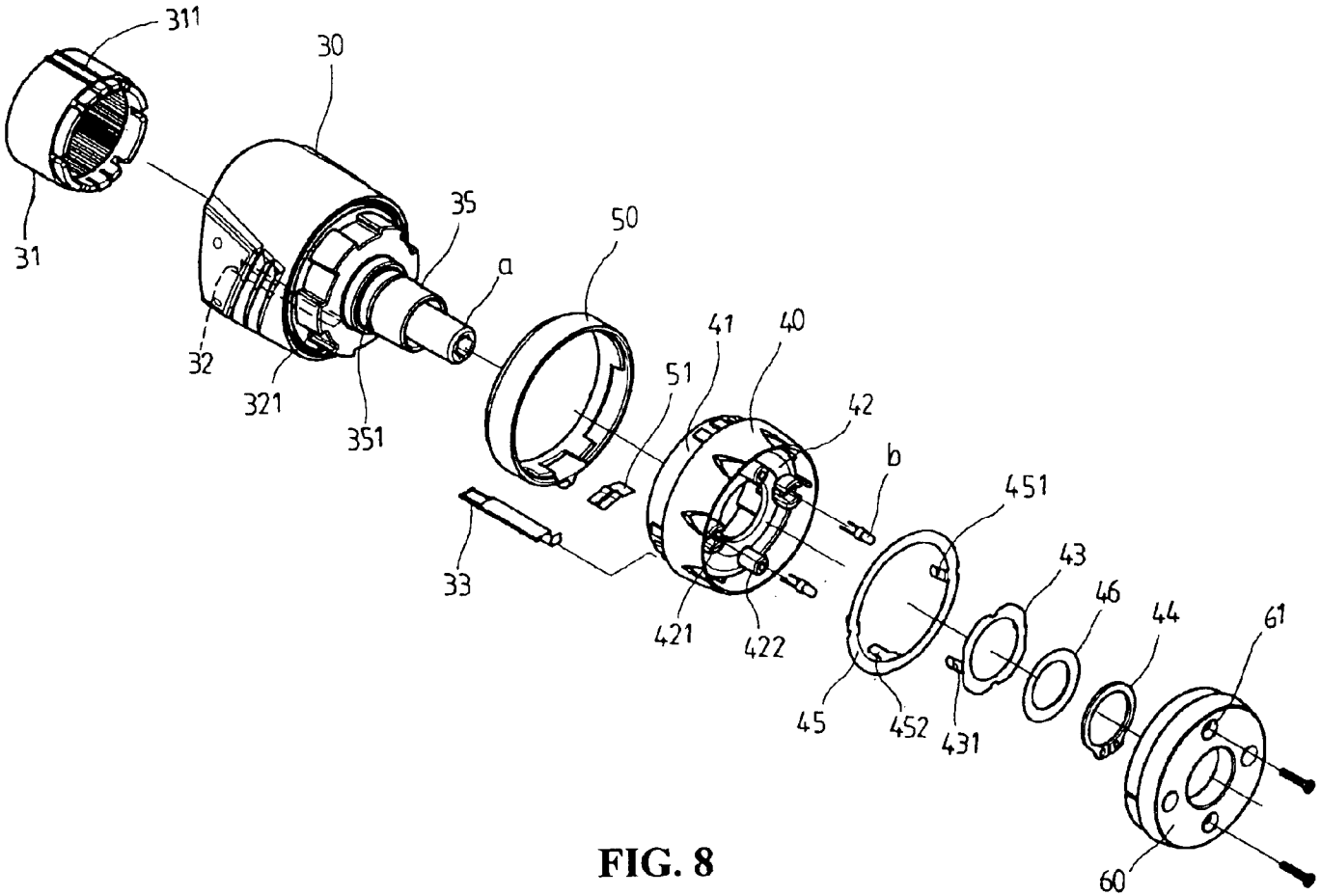
FIG. 8 is an exploded view to show yet another embodiment of the present invention.
Figure 9A:
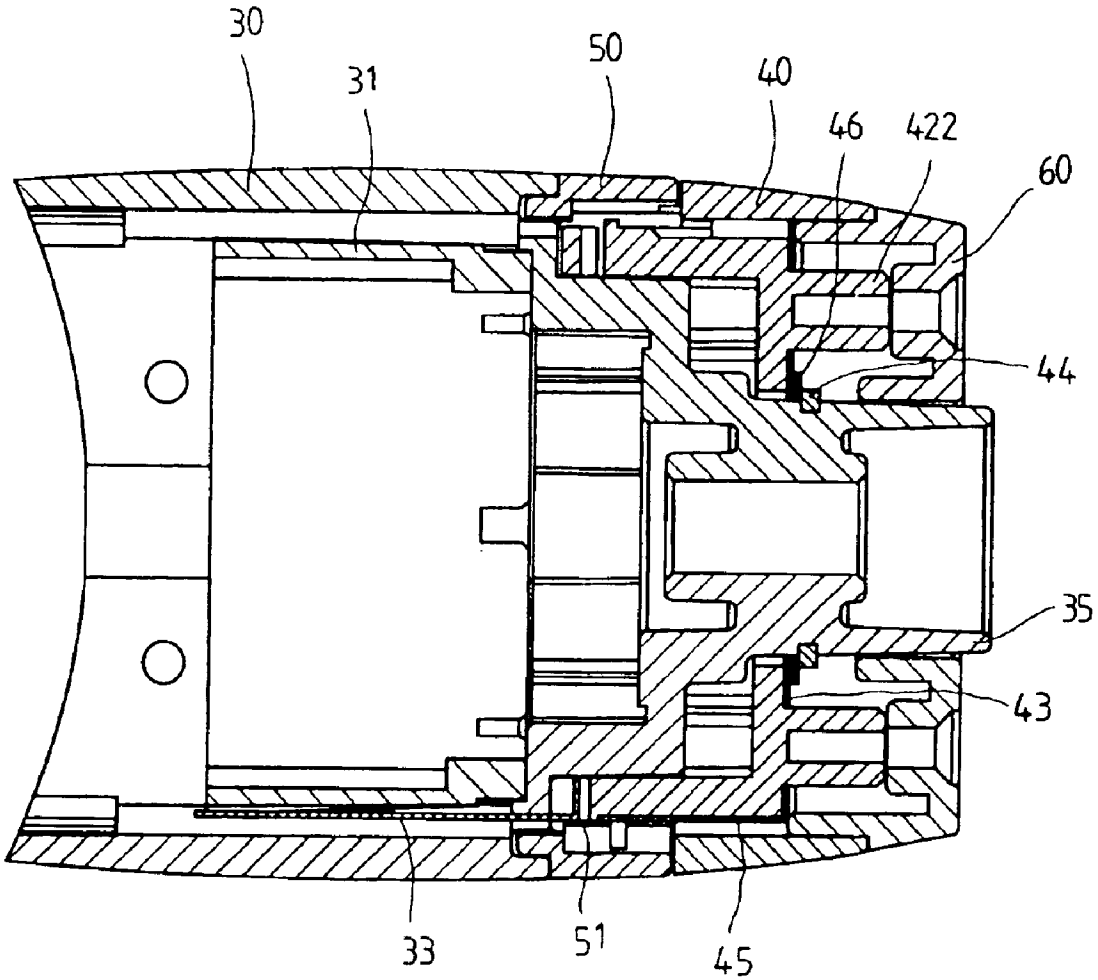
FIG. 9A is a cross sectional view to show the contact piece of the annular switch contacts the position plate and the extension of the positive ring shown in FIG. 8.
Figure 9B:
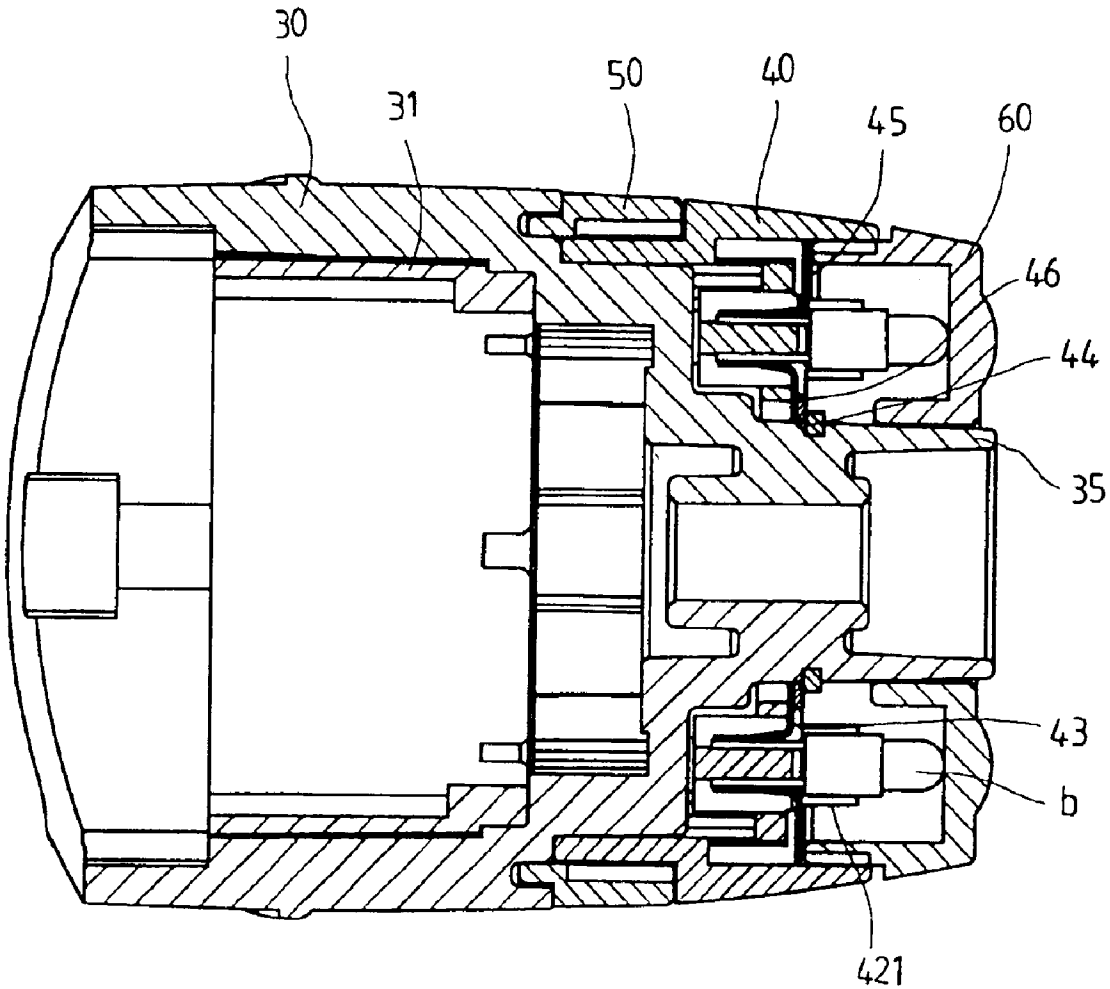
FIG. 9B shows the light bulbs connected to the light frame in the embodiment in FIG. 8.
Figure 10:
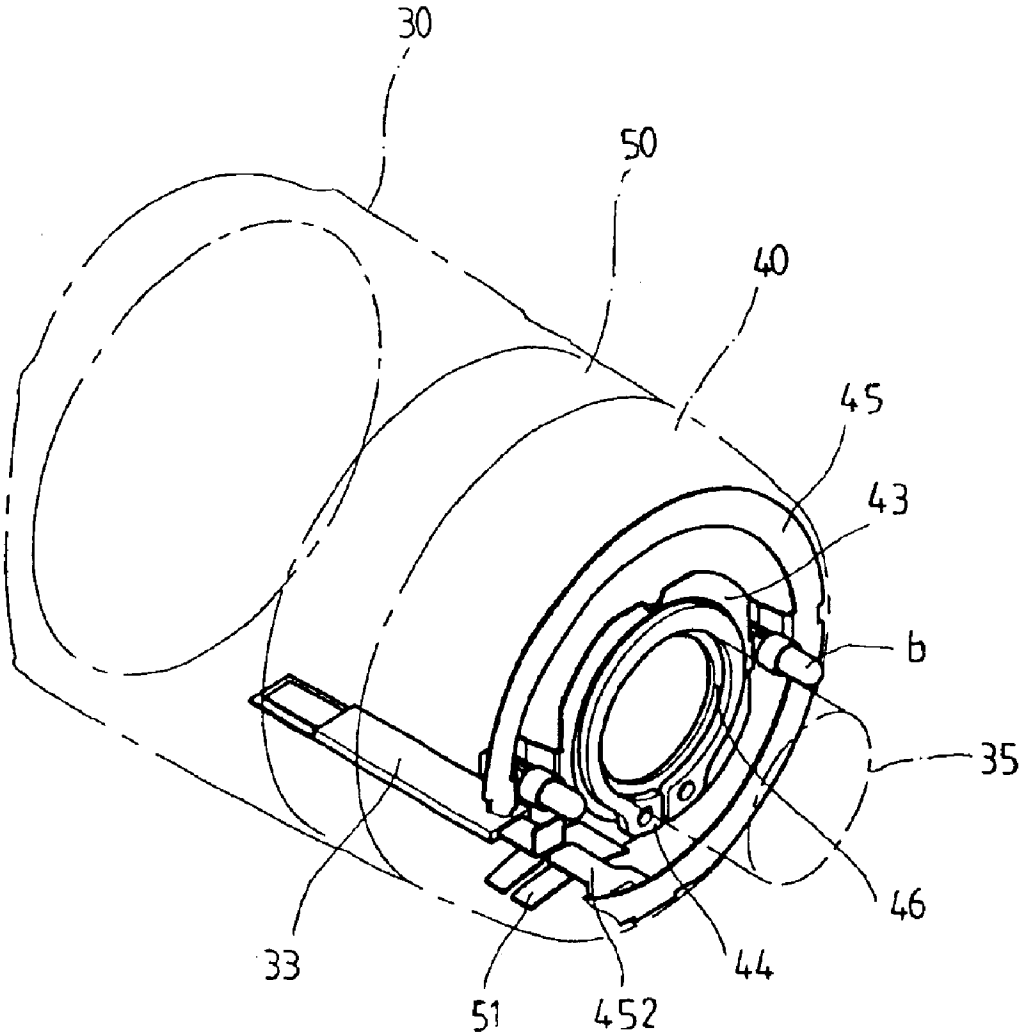
FIG. 10 is a perspective view to show the status as shown in FIG. 9A.
Figure 11:
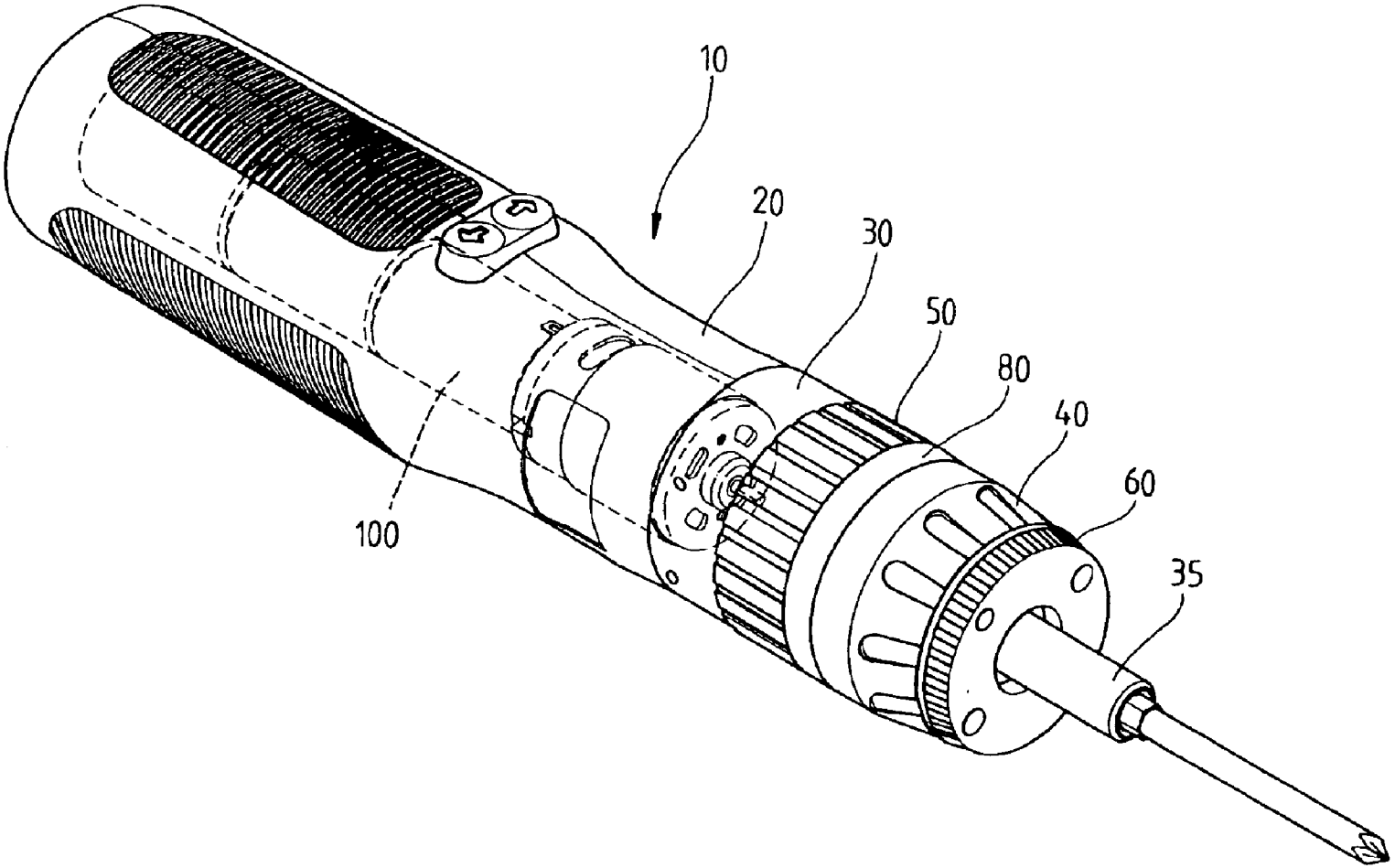
FIG. 11 is a perspective view to show the screwdriver cooperated with a torque adjusting device.
Figure 12:
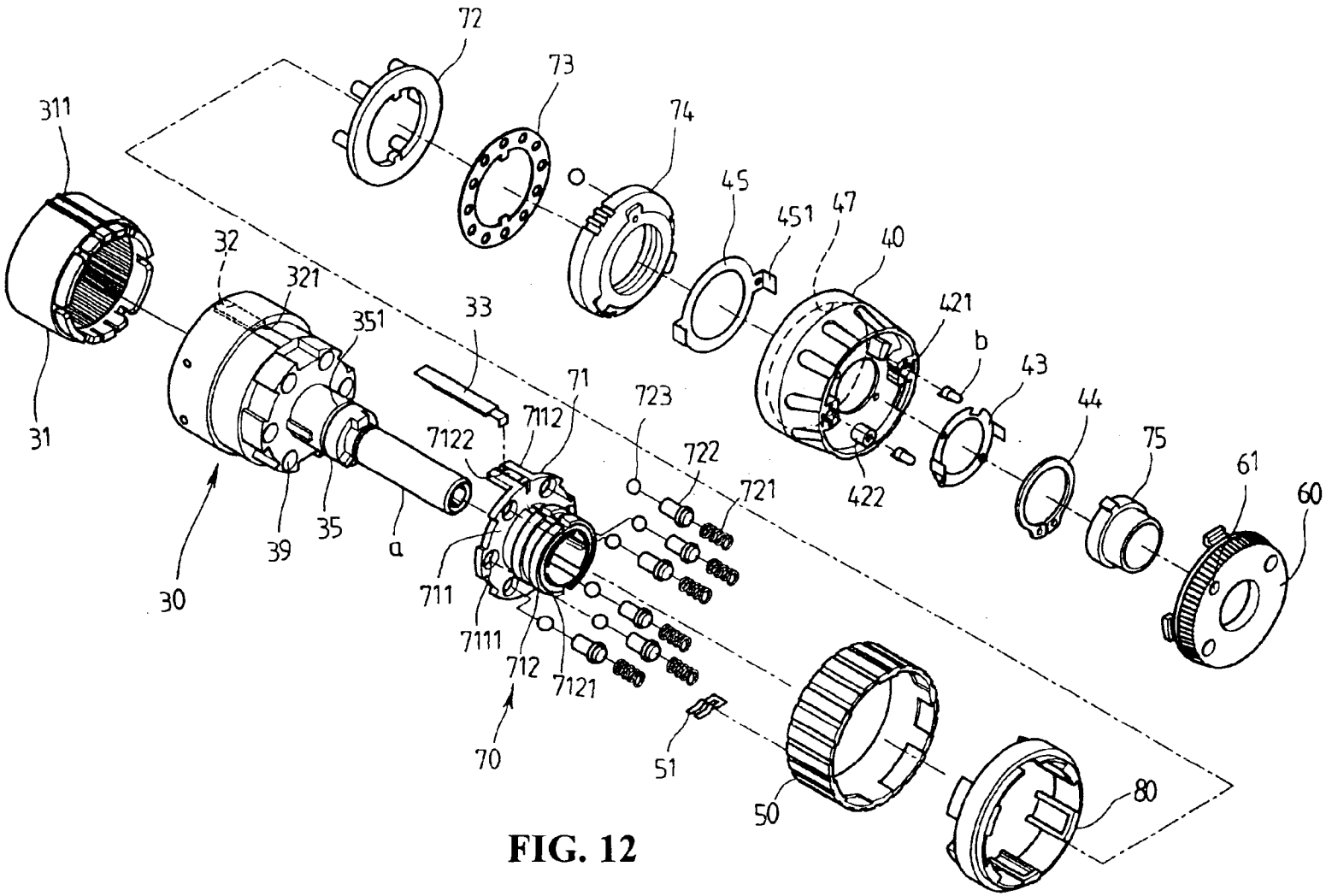
FIG. 12 is an exploded view to show the light device, the gear mechanism and the torque adjusting device for the screwdriver of the present invention shown in FIG. 11.
Figure 13:
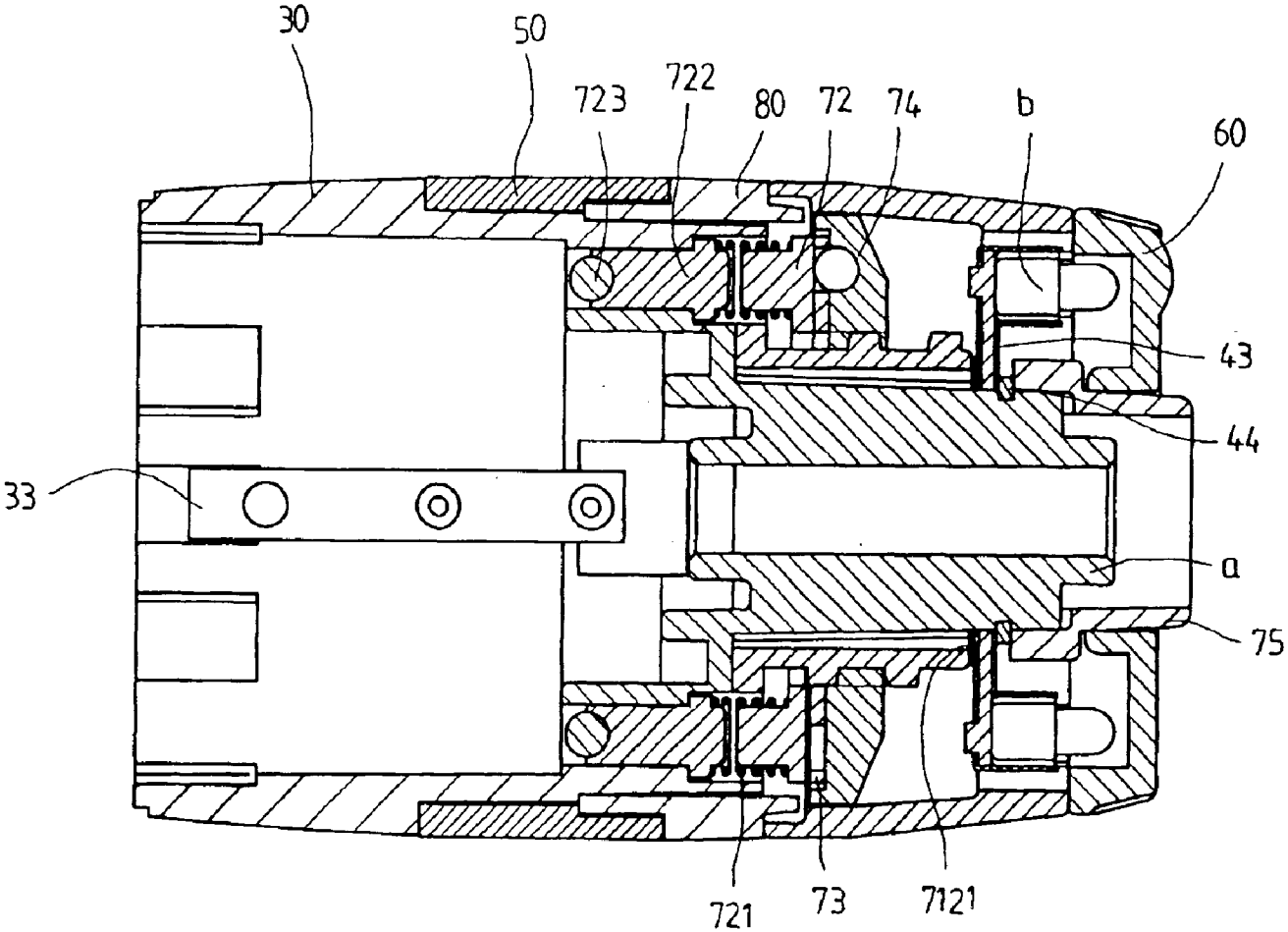
FIG. 13 is a cross sectional view to show the embodiment as shown in FIG. 11.
Figure 14:
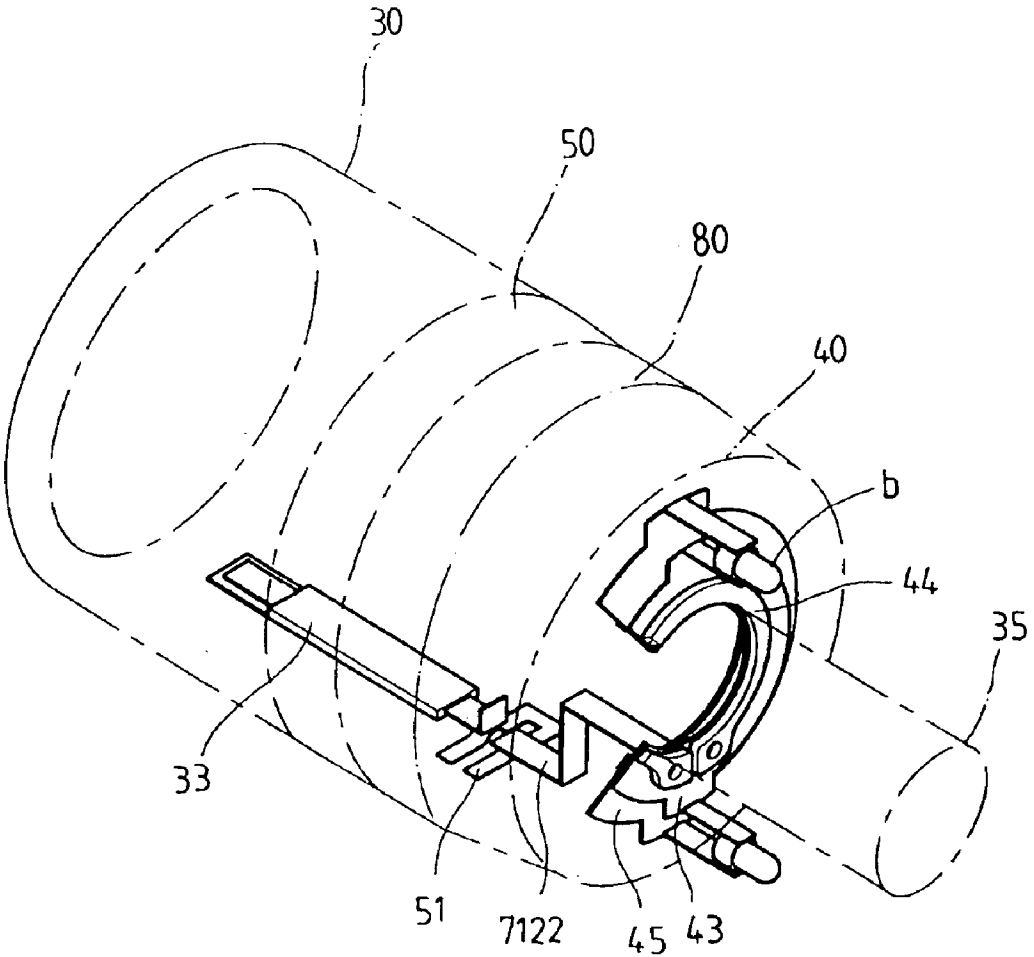
FIG. 14 is a perspective view to show the status when the contact piece of the annular switch contacts the position plate and the conductive port.

Referring to FIGS. 5 to 7, another embodiment of the screwdriver is shown and comprises a handle 20 having a plastic gear mechanism 30 received therein and a bit engaging device 37 is connected to a first end of the gear mechanism 30 which is connected to a power source 100 (not shown). The gear mechanism 30 includes a ring 31 which includes teeth defined in an inner periphery thereof so as to drive gears (not shown) in the gear mechanism 30. Two ridges 311 extending from an outer periphery of the ring 31 and are engaged with grooves 32 (only one is shown) defined longitudinally in the gear mechanism 30. A positive plate 33 and a negative plate 34 are respectively inserted into the grooves 32 via openings 321 in the first end of the gear mechanism 30.

A light bulb "b" is inserted in a bulb receiving member 371 on the first end of the gear mechanism 30. A positive ring 38 is mounted to the bit engaging device 37 and includes a positive lug 381 and a negative lug 382. The light bulb "b" is connected to the positive lug 381 and the negative plate 34. A gap is defined between the positive plate 33 and the negative lug 382.

A fixing ring 60 is engaged with the first end of the gear mechanism 30 and includes a central hole through which the shank of the bit engaging device 37 extends. Two positioning holes and a bulb hole 61 are defined through the fixing ring 60. Two positioning rods 422 extend from the first end of the bit engaging device 37 and extend through the positioning holes and the light bulb "b" extends through the two bulb holes 61.

An annular switch 50 is rotatably mounted to the gear mechanism 30 and includes a pressing portion 52 to press onto the positive ring 38 and a touch piece 51 protrudes inward from an inner periphery of the annular switch 50, the touch piece 51 contacting both of the position plate 33 and the negative lug 382 of the positive ring 38 to light the light bulb "b".

Referring to FIGS. 8, 9A, 9B and 10, yet another embodiment of the screwdriver comprises a handle (not shown) having a metal gear mechanism 30 and a bit engaging device 35 is connected to a first end of the gear mechanism 30. A power source 100 (not shown) is connected to the gear mechanism 30 so as to provide electric power to the gear mechanism 30 to rotate the sleeve "a". The gear mechanism 30 includes a ring 31 which includes teeth defined in an inner periphery thereof so as to drive gears (not shown) in the gear mechanism 30. Two ridges 311 extending from an outer periphery of the ring 31 and are engaged with a groove 32 defined longitudinally in the gear mechanism 30. A positive plate 33 is inserted into the grooves 32 via openings 321 in the first end of the gear mechanism 30.

A light frame 40 is connected to the gear mechanism 30 and includes two bulb receiving members 421 on a flange 42 of an inner periphery of the light frame 40. Two light bulbs "b" are connected to the bulb receiving members 421 of the light frame 40. The light frame 40 includes a connection end 41 which is connected to the gear mechanism 30. A positive ring 45 and a negative ring 43 are respectively engaged with the light frame 40. The positive ring 45 has two connection pieces 451 inserted in the two bulb receiving members 421 and the negative ring 43 has two connection pieces 431 which are inserted in the two bulb receiving members 421 so that the two light bulbs "b" are connected to the positive ring 45 and the negative ring 43. A fixing collar 44 is engaged in a groove 351 defined in an outer periphery of the bit engaging device 35 and a spring ring 46 is sandwiched between the negative ring 43 and the fixing collar 44 so as to press the negative ring 43 in position and form a loop circuit.

A fixing ring 60 which is engaged with the first end of the gear mechanism 30 and includes a central hole through which the bit engaging device 35 extends. Two positioning holes and two bulb holes 61 are defined through the fixing ring 60. The light frame 40 includes two positioning rods 422 which extend through the positioning holes and the light bulbs "b" extend through the two bulb holes 61. A gap is defined between the positive plate 33 and an extension 452 of the positive ring 45 to form an open circuit for the light bulbs "b".

An annular switch 50 is rotatably mounted to the connection end 41 of the light frame 40 and includes a touch piece 51 which protrudes inward from an inner periphery of the annular switch 50 and can be moved to contact both of the position plate 33 and the extension 452 of the positive ring 45 by rotating the annular switch 50 to light the light bulbs "b".

Referring to FIGS. 11 to 14, a screwdriver 10 with a torque adjusting device 70 is shown and comprises a handle 20 having a metal gear mechanism 30 received therein and a bit engaging device 35 is connected to a first end of the gear mechanism 30 so that a sleeve "a" can be connected to the bit engaging device 35. A power source 100 is connected to the gear mechanism 30 so as to provide electric power to the gear mechanism 30 to rotate the sleeve "a". The gear mechanism 30 includes a ring 31 which includes teeth defined in an inner periphery thereof so as to drive gears (not shown) in the gear mechanism 30. Two ridges 311 extending from an outer periphery of the ring 31 and are engaged with a grooves 32 defined longitudinally in the gear mechanism 30. A positive plate 33 is inserted into the groove 32 via openings 321 in the first end of the gear mechanism 30.

A torque adjusting device 70 is mounted to the bit engaging device 35 and has a base 71, a collar 72, a torque scale plate 73, a rotatable cap 74 and an end piece 75. The base 71 has a flange 711 and a threaded tube 712 connected to the flange 711, the collar 72 is mounted to the threaded tube 712. The flange 711 has a plurality of holes 7111 and each have a spring 721 extending therethrough. An end of each spring 721 contacts a pin 722 which urges a bead 723 received in recesses 39 defined in an end surface of the handle 20. The other end of each spring 721 contacts the collar 72. The torque scale plate 73 is mounted to the threaded tube 712 and the rotatable cap 74 is threadedly connected to the threaded tube 712 and compresses the torque scale plate 73. A plurality of beads are engaged between the torque scale plate 73 and the rotatable cap 74.

A positive plate 33 is connected to the torque adjusting device 70 and connected to a power source 100. The flange 711 of the base 71 is engaged with a positioning ring 80 and has an extension 7112. A conductive port 7122 is connected to the extension 7112 and a conductive ring 7121 is connected to an end of the threaded tube 712. An end of the positive plate 33 is connected to the extension 7112 and a gap is defined between the conductive port 7122 and the positive plate 33.

A light frame 40 is connected to a negative ring 43 which has two connection pieces 431 and a connection portion 47 is connected to an end of the light frame 40. A fixing collar 44 is engaged in a groove 351 defined in an outer periphery of the bit engaging device 35 so as to press the negative ring 43 in position. The connection portion 47 is connected with the positioning ring 80 and a position ring 45 is connected to the connection portion 47. The positive ring 45 has two connection pieces 451 so that two light bulbs "b" inserted in two bulb receiving members 421 on the light frame 40 are connected to the two connection pieces 451 and two connection pieces 431 of the negative ring 43. The springs 721 pushes the conductive ring 7121 on the threaded tube 712 to contact the positive ring 45.

A fixing ring 60 which is engaged with the first end of the gear mechanism 30 and includes a central hole through which the bit engaging device 35 extends. Two positioning holes and two bulb holes 61 are defined through the fixing ring 60. The light frame 40 includes two positioning rods 422 which extend through the positioning holes and the light bulbs "b" extend through the two bulb holes 61.

An annular switch 50 is rotatably mounted to the positioning ring 80 and has a touch piece 51 which contacts the positive plate 33 and the conductive port 7122 to light the light bulbs "b".

While we have shown and described the embodiment in accordance with the present invention, it should be clear to those skilled in the art that further embodiments may be made without departing from the scope of the present invention.

What is claimed is:

1. A screwdriver comprising:

a handle having a plastic gear mechanism and a bit engaging device connected to a first end of the gear mechanism, a power source connected to the gear mechanism, a positive plate and a negative plate respectively connected to the gear mechanism received in the handle, a light frame connected to the gear mechanism and at least one light bulb connected to the light frame, a positive ring and a negative ring respectively engaged with the light frame, a spring mounted to the bit engaging device and connected between the negative ring and the negative plate, the at least one light bulb connected to the positive ring and the negative ring, a gap defined between the positive plate and an extension of the positive ring, and an annular switch rotatably mounted to the light frame and including a touch piece which contacts both of the position plate and the extension of the positive ring to light the at least one light bulb.

2. The screwdriver as claimed in claim 1, wherein the touch piece protrudes inward from an inner periphery of the annular switch.

3. The screwdriver as claimed in claim 1, wherein the gear mechanism includes two grooves longitudinally defined therein so that the positive plate and the negative plate are respectively engaged with the two grooves.

4. The screwdriver as claimed in claim 1 further comprising a fixing ring which is engaged with the first end of the gear mechanism and includes a central hole through which the bit engaging device extends, two positioning holes and at least one bulb hole defined through the fixing ring, the light frame including two positioning rods which extend through the positioning holes and the at least light bulb extends through the at least one bulb hole.

5. A screwdriver comprising:

a handle having a plastic gear mechanism received therein and a bit engaging device connected to a first end of the gear mechanism, a power source connected to the gear mechanism, a positive plate and a negative plate respectively connected to the gear mechanism, at least one light bulb connected to the first end of the gear mechanism, a positive ring mounted to the bit engaging device and including a positive lug and a negative lug, the at least one light bulb connected to the positive lug and the negative plate, a gap defined between the positive plate and the negative lug, and an annular switch rotatably mounted to the gear mechanism and including a pressing portion to press onto the positive ring and a touch piece which contacts both of the position plate and the negative lug of the positive ring to light the light bulb.

6. The screwdriver as claimed in claim 5, wherein the touch piece protrudes inward from an inner periphery of the annular switch.

7. The screwdriver as claimed in claim 5, wherein the gear mechanism includes two grooves longitudinally defined therein so that the positive plate and the negative plate are respectively engaged with the two grooves.

8. The screwdriver as claimed in claim 5 further comprising a fixing ring which is engaged with the first end of the gear mechanism and including a central hole through which the bit engaging device extends, two positioning holes and at least one bulb hole defined through the fixing ring, two positioning rods extending from the end surface of the handle and extending through the positioning holes and the at least light bulb extending through the at least one bulb hole.

9. A screwdriver comprising:

a handle having a metal gear mechanism and a bit engaging device connected to a first end of the gear mechanism, a power source connected to the gear mechanism, a positive plate connected to the gear mechanism received in the handle, a light frame connected to the gear mechanism and at least one light bulb connected to the light frame, the positive plate connected to the light frame, a positive ring and a negative ring respectively engaged with the light frame, a conductive spring ring and a fixing collar respectively mounted to the bit engaging device such that the conductive spring ring contacting the negative ring, the at least one light bulb connected to the positive ring and the negative ring, a gap defined between the positive plate and an extension of the positive ring, and an annular switch rotatably mounted to the light frame and including a touch piece which contacts both of the position plate and the extension of the positive ring to light the at least one light bulb.

10. The screwdriver as claimed in claim 9, wherein the touch piece protrudes inward from an inner periphery of the annular switch.

11. The screwdriver as claimed in claim 9, wherein the gear mechanism includes a groove longitudinally defined therein so that the positive plate is engaged with the groove.

12. The screwdriver as claimed in claim 9 further comprising a fixing ring which is engaged with the first end of the gear mechanism and includes a central hole through which the bit engaging device extends, two positioning holes and at least one bulb hole defined through the fixing ring, the light frame including two positioning rods which extend through the positioning holes and the at least light bulb extends through the at least one bulb hole.

13. A screwdriver comprising:

a handle having a metal gear mechanism received therein and a bit engaging device connected to a first end of the gear mechanism, a power source connected to the gear mechanism, a positive plate connected to the gear mechanism, a torque adjusting device mounted to the bit engaging device and having a base, a collar, a torque scale plate, a rotatable cap and an end piece, the base having a flange and a threaded tube extending from the flange, the collar mounted to the threaded tube, the flange having a plurality of holes and each having a spring extending therethrough, an end of each spring contacting a pin which urges a bead received in recesses defined in an end surface of the handle, the other end of each spring contacting the collar, the torque scale plate mounted to the threaded tube and the rotatable cap threadedly connected to the threaded tube and compressing the torque scale plate, a plurality of beads engaged between the torque scale plate and the rotatable cap;

a positive plate connected to the torque adjusting device and connected to a power source, the flange of the base engaged with a positioning ring and having an extension, a conductive port connected to the extension, a conductive ring connected to an end of the threaded tube, an end of the positive plate connected to the extension and a gap defined between the conductive port and the positive plate;

a light frame connected to a negative ring which has two connection pieces and a connection portion connected to an end of the light frame, the connection portion connected with the positioning ring 80 and a position ring connected to the connection portion, the positive ring having two connection pieces so that two light bulbs connected to the two connection pieces and two connection pieces of the negative ring, the springs pushing the conductive ring on the threaded tube to contact the positive ring, and an annular switch rotatably mounted to the positioning ring and having a touch piece which contacts the positive plate and the conductive port to light the light bulbs.

* * * * *